US010377160B2

(12) United States Patent
Liu et al.

(10) Patent No.: US 10,377,160 B2
(45) Date of Patent: Aug. 13, 2019

(54) DIE ALIGNMENT WITH INDEXING SCANBAR

(71) Applicant: Hewlett-Packard Development Company, L.P., Houston, TX (US)

(72) Inventors: Hsue-Yang Liu, Vancouver, WA (US); Matthew A Shepherd, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/758,897

(22) PCT Filed: Nov. 19, 2015

(86) PCT No.: PCT/US2015/061595

§ 371 (c)(1),
(2) Date: Mar. 9, 2018

(87) PCT Pub. No.: WO2017/086978

PCT Pub. Date: May 26, 2017

(65) Prior Publication Data

US 2018/0244090 A1 Aug. 30, 2018

(51) Int. Cl.

| | |
|---|---|
| ***B41J 29/393*** | (2006.01) |
| ***B41J 29/38*** | (2006.01) |
| ***B41J 2/175*** | (2006.01) |
| ***B41J 2/155*** | (2006.01) |
| ***B41J 2/045*** | (2006.01) |

(52) U.S. Cl.

CPC ..... *B41J 29/393* (2013.01); *B41J 2/04505* (2013.01); *B41J 2/04558* (2013.01); *B41J 2/155* (2013.01); *B41J 2/175* (2013.01); *B41J 29/38* (2013.01); *B41J 2029/3935* (2013.01)

(58) Field of Classification Search

CPC ..... B41J 2/04505; B41J 2029/3935

See application file for complete search history.

(56) References Cited

U.S. PATENT DOCUMENTS

| | | | |
|---|---|---|---|
| 4,438,917 | A | 3/1984 | Janssen et al. |
| 5,278,624 | A | 1/1994 | Kamprath et al. |
| 5,715,514 | A | 2/1998 | Williams et al. |

(Continued)

FOREIGN PATENT DOCUMENTS

EP 0978390 A1 2/2000

OTHER PUBLICATIONS

Wannous, et al. "Improving color correclion across camera and illumination changes by contextual sample selection"~Journal of Electronic Imaging~Jul. 20, 2012~31 pages.

*Primary Examiner* — Shelby L Fidler
(74) *Attorney, Agent, or Firm* — Dicke Billig & Czaja PLLC

(57) ABSTRACT

A method including printing a calibration pattern with a wide array printhead having a plurality of printhead dies. The method includes scanning the calibration pattern with a scanbar having a width less than a width of the wide array printhead by indexing the scanbar to a plurality of selected positions across a width of the calibration pattern and providing a scanned calibration image at each selected position, the calibration images together providing a scan of the full width of the calibration pattern, and measuring alignment between successive printhead dies based on the calibration images.

15 Claims, 4 Drawing Sheets

(56) References Cited

U.S. PATENT DOCUMENTS

| | | | | |
|---|---|---|---|---|
| 6,076,915 | A | 6/2000 | Gast et al. | |
| 7,547,903 | B2 * | 6/2009 | Mizes | G03G 15/5062 250/559.1 |
| 8,297,616 | B2 | 10/2012 | Tharayil | |
| 9,050,823 | B2 | 6/2015 | Ratjen | |
| 2001/0009429 | A1 | 7/2001 | Soto et al. | |
| 2003/0189161 | A1 * | 10/2003 | Perregaux | H01L 27/14601 250/208.1 |
| 2005/0062784 | A1 * | 3/2005 | Matsuzaki | B41J 2/04505 347/19 |
| 2006/0114282 | A1 | 6/2006 | Mizes et al. | |
| 2006/0132526 | A1 | 6/2006 | Donovan | |
| 2006/0274107 | A1 | 12/2006 | Anderson et al. | |
| 2007/0024660 | A1 | 2/2007 | Bailey et al. | |
| 2010/0219328 | A1 * | 9/2010 | Ruff | H01L 27/146 250/208.1 |
| 2011/0012949 | A1 | 1/2011 | Enge et al. | |
| 2013/0201245 | A1 | 8/2013 | Donaldson | |
| 2014/0285822 | A1 * | 9/2014 | Regelsberger | B41J 2/04505 358/1.2 |
| 2015/0375550 | A1 * | 12/2015 | Mizes | G06K 15/10 347/19 |
| 2016/0355006 | A1 * | 12/2016 | Reder | B41J 2/04505 |

* cited by examiner

DIE ALIGNMENT WITH INDEXING SCANBAR

BACKGROUND

Page wide array (PWA) inkjet printheads, sometimes referred to as printbars, employ a plurality of printhead dies typically arranged in an offset and staggered fashion so as to span a print path. The printhead dies include an array of print nozzles, the nozzles being controllably sequenced to eject ink drops in accordance with print data so as to collectively form a desired image in a single pass on a print medium as the print medium is continually advanced along the print path past the printhead.

DETAILED DESCRIPTION

Figure 1:
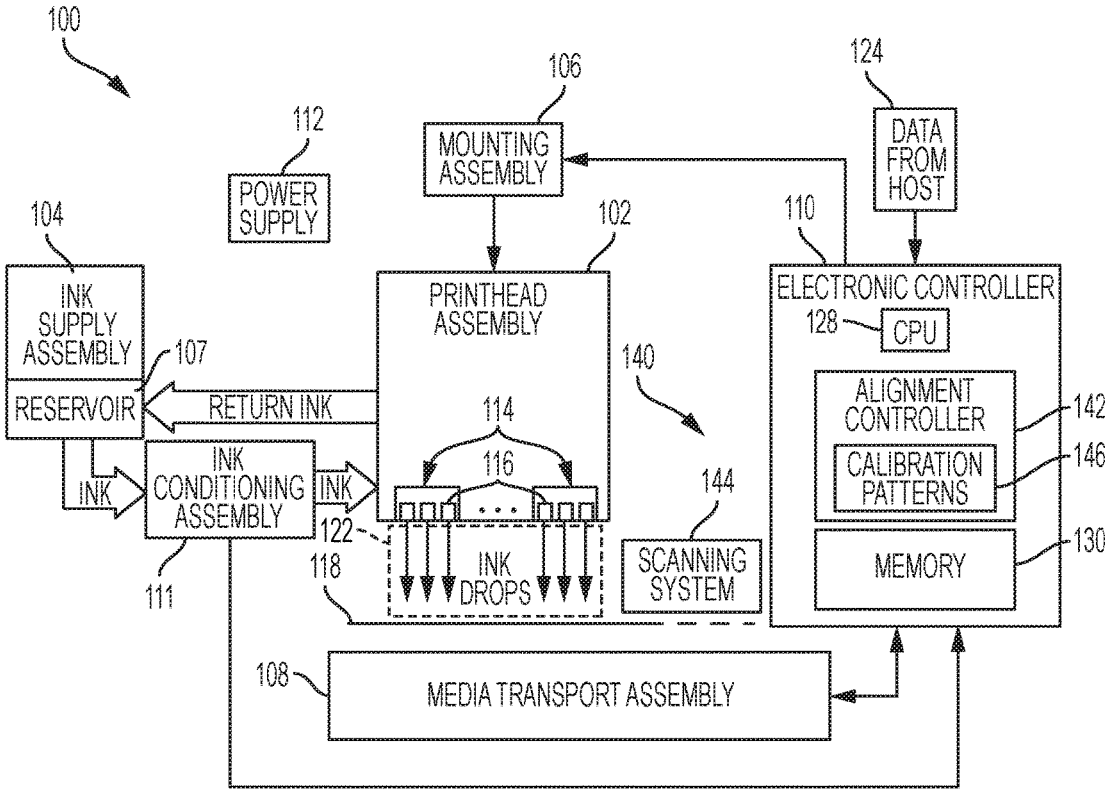
FIG. 1 is a block and schematic diagram generally illustrating an inkjet printing system including a scanbar according to one example.

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Page wide array (PWA) printheads employ a plurality of printhead dies, each printhead die including an array of print nozzles for ejecting ink drops. The printhead dies are typically arranged in a staggered and offset fashion across a full width of a print path, with the arrays of print nozzles of the plurality of printhead dies together forming a print zone. As print media is advanced through the print zone, the nozzles of the printhead dies are controllably sequenced in accordance with print data and movement of the print media, with appropriate delays to account for offsets between rows of nozzles and the staggered separation of the printhead dies, so that the arrays of nozzles of the printhead dies together form a desired image on the print media in a single pass as the print media is moved through the print zone.

Due to mechanical tolerances, misalignment can occur between printhead dies which results in misregistration or misalignment between the printed drops of ink forming the image, thereby producing errors or artifacts in the printed image. To eliminate such errors, printers typically employ calibration systems to measure misalignment between printhead dies, with the measured misalignment used as a basis for some type of correction operation to compensate for die misalignment, such as adjusting the timing/sequencing of nozzle drop ejection between printhead dies, for example. Such calibration systems typically include printing a calibration page including a calibration pattern. The calibration pattern is scanned using an optical sensor to provide a digital image of the calibration pattern (e.g., optical density or reflectance), with misalignment between printhead dies being determined from pixel values of the digital image.

Some calibration systems employ densitometers mounted on a moving carriage to scan the calibration page. While inexpensive, such scanning is time consuming and image resolution can be poor. Other systems employ high-performance scanbars including a linear array of sensors (also referred to as pixels) spanning a full width of the printing path. While such scanbars provide a high degree of accuracy and reduce scanning times, such full-width scanbars are costly, particularly for widths exceeding standard letter size widths (i.e. A3).

FIG. 1 is a block and schematic diagram generally illustrating a PWA inkjet printing system 100 employing a low-cost scanbar having multiple sensor chips and a width less than a printing width of the PWA printhead for measuring die-to-die alignment, in accordance with the present application. As will be described in greater detail below, employing a low-cost scanbar in accordance with the present application provides faster and more accurate scanning of calibration patterns relative to scanning densitometers at a reduced cost relative to high-performance, full-width scanbars.

Inkjet printing system 100 includes an inkjet printhead assembly 102, an ink supply assembly 104 including an ink storage reservoir 107, a mounting assembly 106, a media transport assembly 108, an electronic controller 110, and at least one power supply 112 that provides power to the various electrical components of inkjet printing system 100.

Inkjet printhead assembly 102 is a wide array printhead including a plurality of printhead dies 114, each of which ejects drops of ink through a plurality of orifices or nozzles 116 toward sheet 118 so as to print onto sheet 118. According to one example, the printhead dies 114 are disposed laterally to one another to form a printbar extending across a full extent of sheet 118. With properly sequenced ejections of ink drops, nozzles 116, which are typically arranged in one or more columns or arrays, produce characters, symbols or other graphics or images to be printed on sheet 118 as inkjet printhead assembly 102 and sheet 118 are moved relative to each other.

In operation, ink typically flows from reservoir 107 to inkjet printhead assembly 102, with ink supply assembly 104 and inkjet printhead assembly 102 forming either a one-way ink delivery system or a recirculating ink delivery system. In a one-way ink delivery system, all of the ink supplied to inkjet printhead assembly 102 is consumed during printing. However, in a recirculating ink delivery system, only a portion of the ink supplied to printhead assembly 102 is consumed during printing, with ink not consumed during printing being returned to supply assembly 104.

In one example, ink supply assembly 104 supplies ink under positive pressure through an ink conditioning assembly 111 to inkjet printhead assembly 102 via an interface connection, such as a supply tube. Ink supply assembly includes, for example, a reservoir, pumps, and pressure regulators. Conditioning in the ink conditioning assembly may include filtering, pre-heating, pressure surge absorption, and degassing, for example. Ink is drawn under negative pressure from printhead assembly 102 to the ink supply assembly 104.

Mounting assembly 106 positions inkjet printhead assembly 102 relative to media transport assembly 108, and media transport assembly 108 positions sheet 118 relative to inkjet printhead assembly 102, so that a print zone 122 is defined adjacent to nozzles 116 in an area between inkjet printhead assembly 102 and sheet 118. In one example, wide array printhead 102 is non-scanning printhead, with mounting assembly 106 maintaining inkjet printhead assembly 102 at a fixed position relative to media transport assembly 108, and with media transport assembly 108 moving sheet 118 relative to stationary inkjet printhead assembly 102.

Electronic controller 110 includes a processor (CPU) 128, a memory 130, firmware, software, and other electronics for communicating with and controlling inkjet printhead assembly 102, mounting assembly 106, and media transport assembly 108. Memory 130 can include volatile (e.g. RAM) and nonvolatile (e.g. ROM, hard disk, floppy disk, CD-ROM, etc.) memory components including computer/processor readable media that provide for storage of computer/processor executable coded instructions, data structures, program modules, and other data for inkjet printing system 100.

Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters. In one implementation, electronic controller 110 controls inkjet printhead assembly 102 for the ejection of ink drops from nozzles 116 of printhead dies 114. Electronic controller 110 defines a pattern of ejected ink drops to form characters, symbols, and/or other graphics or images on sheet 118 based on the print job commands and/or command parameters from image data 124.

According to one example, as will be described in greater detail below, inkjet printing system 100 includes a die alignment system 140 including an alignment controller 142 and a scanning system 144 for measuring die-to-die alignment between printhead dies 114 of printhead assembly 102 based on a plurality of scanned images of a printed calibration pattern provided by scanning system 144, the plurality of scanned images together providing a full-width image of the printed calibration pattern. In one example, alignment controller 142 may implemented as a combination of hardware/firmware for implementing the functionality of die alignment system 140. In one example, at least portions of alignment controller 142 may be implemented as computer executable instructions stored in a memory, such as memory 130, that when executed by a processor, such as process 128, implement the functionality of die alignment system 140. In one example, alignment controller 142 includes image data 146 for the printing a plurality of die calibration patterns by printhead assembly 102.

Figure 2:
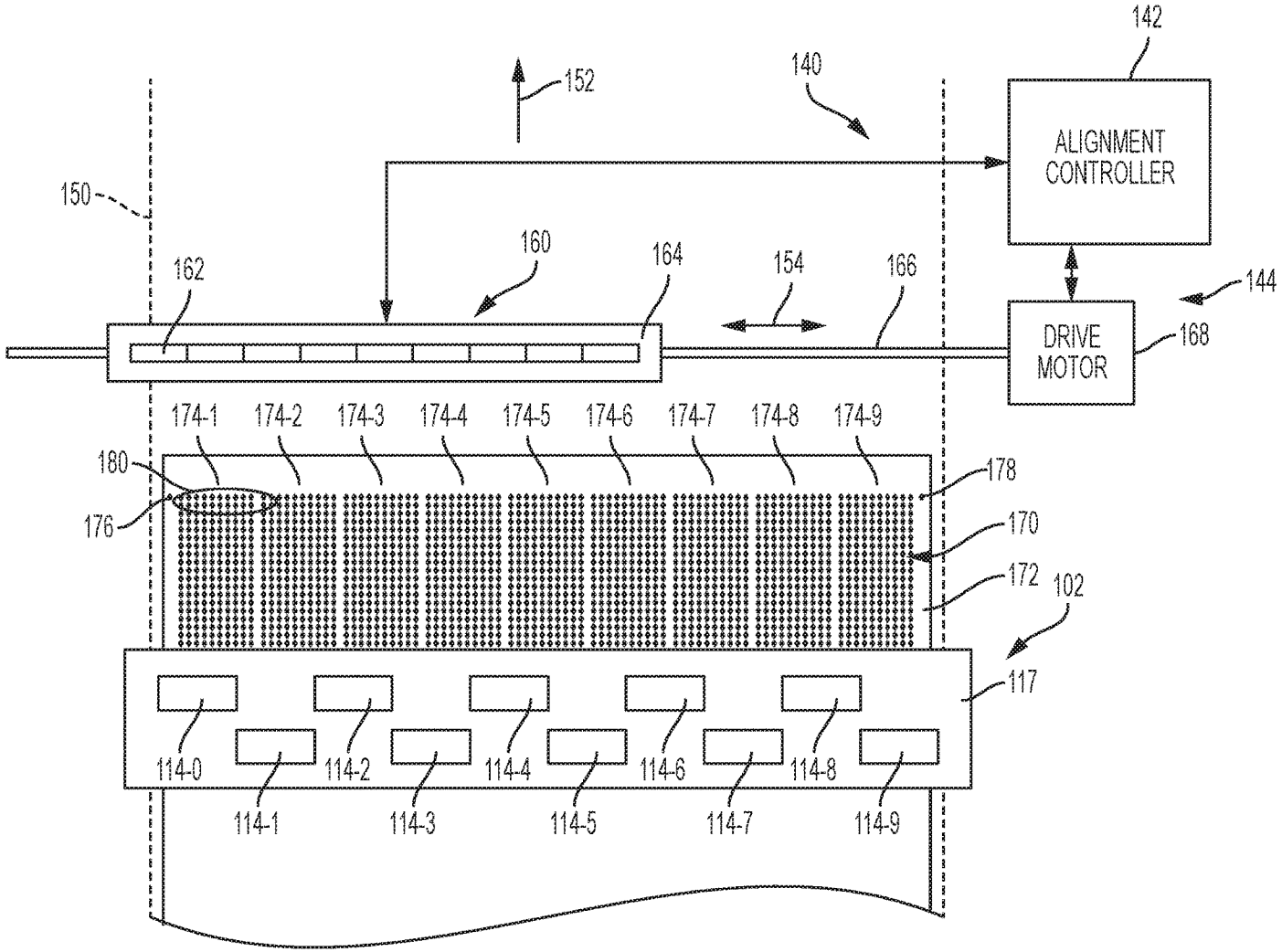
FIG. 2 is a block and schematic diagram illustrating a die alignment system including a scanbar according to one example.

FIG. 2 is a block and schematic diagram illustrating portions of inkjet printing system 100 including page-wide array printhead or printbar 102 and die alignment system 140, according to one example. As illustrated in FIG. 2, printbar 102 includes a plurality of printhead dies 114, illustrated as printhead dies 114-0 to 114-9, which are mounted to a common support structure 117 in an offset and staggered fashion so as to extend transversely across a print path 150 (indicted by dashed lines). Each printhead die 114 includes a plurality of print nozzles 116, typically arranged in an array of rows and columns, which are controllably sequenced in accordance with print data and movement of a page of print media along a transport path 150, with appropriate delays to account for offsets between rows of nozzles and offsets between printhead dies 114, so that the arrays of nozzles of printhead dies 114 together form a desired image on the page of media in a single pass as the page moves in a print direction 152 along print path 150.

In example, die alignment system 140 includes alignment controller 142 and scanning system 144. According to one example, scanning system 144 includes a scanner 160 having a plurality of sensor chips 162 mounted in an end-to-end fashion on a substrate or scanner body 164 and extending transversely to print direction 152 across print path 150. In one example, scanner 160 is a scanbar 160 having a linear array of optical sensors. Scanbar 160 has a scanning width, in a direction orthogonal to print direction 152, that is less than a width of printbar 102 and a width of a printed calibration pattern 170 (which will be described in greater detail below). Scanbar 160 can be driven back and forth transversely to print direction 152, as indicated by directional arrows 154, along carriage rod 166 by a drive motor 168. In one example, alignment controller 142, via drive motor 168, can index or position the array of sensor chips 162, to any desired position across the width of print path 150, including to a "home" position as illustrated in FIG. 2.

Figure 3:
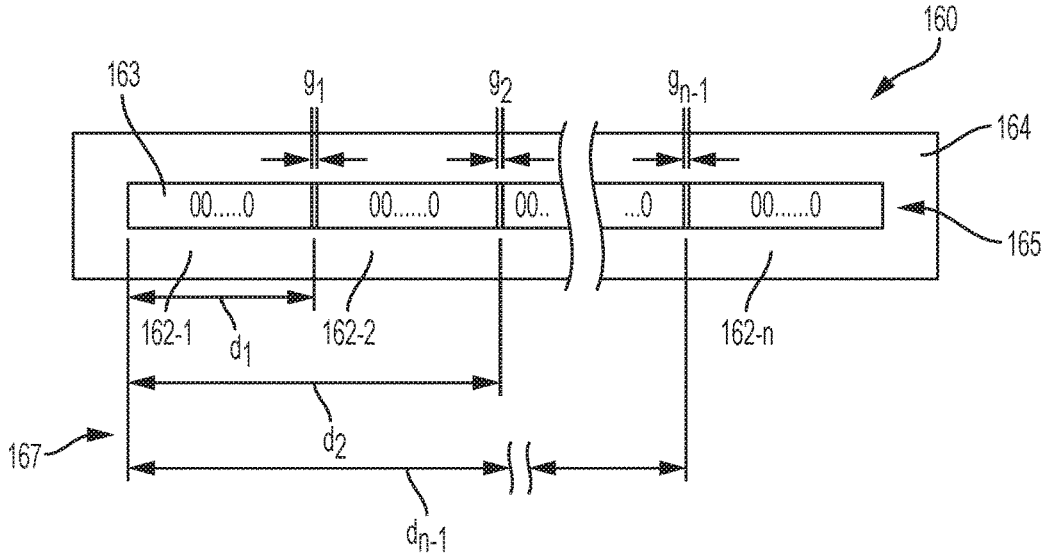
FIG. 3 is a block and schematic diagram illustrating a scanbar, according to one example.

FIG. 3 is a block and schematic diagram generally illustrating scanbar 160 according to one example. Scanbar 160 includes a plurality of sensor chips 162, illustrated as sensor chips 162-1 to 162-n, each including a linear array of optical light sensing elements or pixels 163. Each pixel measures an amount of reflected light (such as from a page of print media), with pixel values ranging between integer values of 0 and 255, according to one example, with a reflectance value of 0 representing a minimal level of received reflected light (such as a portion of print media printed with black ink, for example), and a reflectance value of 255 representing a maximum level of received reflected light (such a portion of print media too which ink has not been printed, for example).

In one example, sensor chips 162 are mounted abutting one another in an end-to-end fashion so that the linear arrays of pixels 163 of each sensor chip 162 together form a combined linear array 165. In one example, scanbar 160 includes 12 sensor chips 162 (although more or few than 12 sensor chips may be employed). In one example, linear array 165 has a width corresponding to an A4 size (letter size, 8.5-inches), while printbar 102 has a printing width corresponding to an A3 size (11.7-inches). In one example, scanbar 144 has a hardware resolution of up to 1200 dots-per-inch (dpi) orthogonal to print direction 152, and a resolution in print direction 152 that is configurable via a scanning speed (i.e., how fast media is transported along print pat 150) and a strobing frequency.

Due to mechanical tolerance, when mounted to scanner body 164, gaps exist between each pair of abutting or adjacent sensor chips 162, such as illustrated by gaps $g_1$ to $g_{n-1}$ wherein each of the chip gaps may have a different width (i.e. chip gaps may vary in width). For instance, according to example, chip gaps $g_1$ to $g_{n-1}$ may vary in width from 6 to 40 μm. In one example, each of the chip gaps $g_1$ to $g_{n-1}$ is at a known distance from a reference point 167 on scanbar 160, such as illustrated by distances $d_1$ to $d_{n-1}$.

Although illustrated as corresponding to an edge of first sensor chip 162-1, reference point 167 can any known point on scanbar 160, such as a first pixel of first sensor chip 162-1, for example. As will be described in greater detail below, unless accounted for, chips gaps, such as chip gaps $g_1$ to $g_{n-1}$ can adversely impact die alignment measurements between printhead dies 116.

With reference to FIG. 2, according to one example, to perform a die alignment procedure, alignment controller 142, via electronic controller 110 (see FIG. 1), instructs printbar 102 to print a calibration pattern 170 on a calibration page 172. According to one example, calibration pattern includes shapes or blocks printed in a specific pattern. In one example, as illustrated, the blocks of calibration pattern 170 are diamond shapes printed in a specific pattern of rows and columns. Although illustrated as being diamond shapes in the illustrated example, any suitable 2-dimensional shape can be employed, such as a circle, a rectangle, or a slanted line, for example. Additionally, the blocks may be printed in any number of patterns other than rows and columns.

According to one example, as illustrated, calibration pattern 170 includes a plurality of regions of interest (ROI) 174, illustrated as ROIs 174-1 to 174-9 in FIG. 2, where each ROI corresponds to a successive pair of printhead dies of printbar 102. In one example, as illustrated, each ROI 174 includes a number of columns and rows of printed shapes, in this case, diamonds. According to the illustrated example, the diamonds of the ROI 174-1 correspond to and are printed by printhead dies 114-0 and 114-1, the diamonds of ROI 174-2 correspond to and are printed by printhead dies 114-1 and 114-2, and so on.

In one example, calibration pattern 170 further includes fiducial markers, such as fiducial diamonds 176 and 178 respectively located in the upper left and upper right corners of calibration page 172. Additionally, although not illustrated, fiducial diamonds may also be printed in the lower left and lower right corners of calibration page 172. As will be described below, in one example, the fiducial diamonds serve as reference points or markers for calibration pattern 170, and are employed by alignment controller 142 for positioning scanbar 160 along carriage bar 166 relative to calibration pattern 170.

Figure 4:
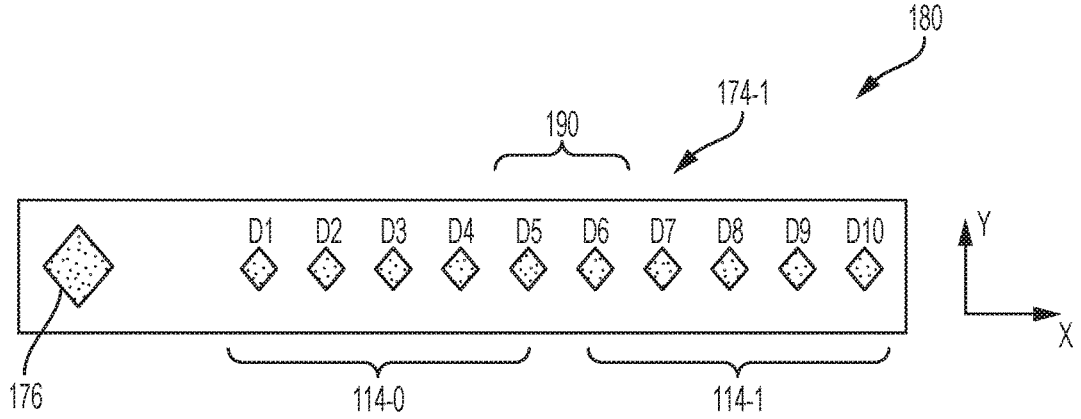
FIG. 4 is a block diagram illustrating a portion of a calibration pattern, according to one example.

FIG. 4 illustrates a portion 180 of calibration pattern 170 of FIG. 2, corresponding to a first row of printed diamonds of ROI 174-1 printed by printhead dies 114-0 and 114-1, along with fiducial diamond 176. As illustrated, ROI 174-1, as well as each of the other ROI's 174-2 to 174-9, includes 10 columns of printed diamonds, D1 to D10. As described above, each ROI 174 includes a plurality of rows of printed diamonds. In one example, each ROI 174 includes as many rows as will fit on a sheet of imaging media, such as 51 rows, for example.

In FIG. 4, diamonds D1 through D5 are printed by printhead die 114-0, and diamonds D6 through D10 are printed by printhead die 114-1. Due to a high degree of accuracy during die fabrication, diamonds printed by a same printhead only minimal misalignment from expected spacing (in the x- and y-directions) is anticipated between diamonds printed by a same printhead, such as diamonds D1 to D5, and diamonds D6 to D10.

However, due to positional tolerances when mounting printhead dies 114 to body 117, misalignment may occur between adjacent diamonds printed by adjacent printheads. These pairs of adjacent diamonds represent an alignment region from which die alignment between the corresponding pair of printhead dies can be measured The pair of adjacent diamonds D5 and D6 in FIG. 4 represent such an alignment region, with diamond D5 being printed by printhead die 114-0 and diamond D6 being printed by printhead die 114-1. To determine die alignment between printhead dies 114-0 and 114-1, a difference, Δx, in the x-direction between a measured spacing and an expected spacing between diamonds D5 and D6, and a difference, Δy, in the y-direction between measured positions of diamonds D5 and D6, represents misalignment between printhead dies 114-0 and 114-1.

According to the present example, the adjacent pair of diamonds D5 and D6 of each column set 174-1 to 174-9 of calibration pattern 170 represent alignment regions for measuring die alignment between the corresponding pairs of printhead dies 114. For example, die alignment between printhead dies 114-8 and 114-9 can be determined by measuring Δx and Δy between diamonds D5 and D6 of corresponding column set 174-9. Although described as being arranged in a grid-like array, the positions of nozzles 116 can randomized so long as the adjacent printed blocks or shapes of alignment region 190 of calibration pattern 170 (e.g., diamonds D5 and D6) are printed by adjacent printhead dies 114 of printbar 102.

According to one example, as will be described in greater detail below, to determine die alignment between each successive pair of printhead dies 114, such as between printhead dies 114-0 and 114-1, between printhead dies 114-2 and 114-3, between printhead dies 114-3 and 114-4, and so on, scanbar 160 provides scanned images of calibration pattern 170. Because scanbar 160 has a width less than the printing width of printbar 102, scanbar 160 provides scanned images at multiple locations along carriage bar 166 in order to scan a full width of calibration pattern 170 and, thus, to provide scanned images of the alignment regions 190 of each ROI 174 of calibration pattern 170.

Based on the scanned images, alignment controller 142 measures the Δx and the Δy between diamonds D5 and D6 in alignment region 190 of each row of each ROI 174. In one example, the measured Δx and the Δy of each row are averaged to determine die alignment between the corresponding pairs of printhead dies 114. For example, to determine die alignment between printhead dies 114-0 and 114-1, alignment controller 142 measures the Δx and the Δy between diamonds D5 and D6 of each row of ROI 174-1 and the averages the measured values.

Because scanbar 160 provides multiple scanned images of calibration pattern 170, adjacent pairs of diamonds D5 and D6 of certain ROI's 174 may be scanned more than once by scanbar 160. According to one example, in such cases, alignment controller 142 measures the Δx and the Δy between diamonds D5 and D6 of each row of the ROI 174 of each scanned image and averages the measured values to determine the alignment between corresponding pair of printhead dies 114.

However, because scanbar 160 includes multiple sensor chips 162, if scanbar 160 is not properly positioned along carriage bar 166 relative to calibration pattern 170, one or more of the gaps $g_1$ to $g_{n-1}$ between sensor chips 162 of scanbar 160 (see FIG. 3) may be aligned with alignment regions 190 of one or more ROI's 174 of calibration pattern 170. In such cases, the gaps $g_1$ to $g_{n-1}$ may distort the scanned images in the associated alignment regions 190, resulting in inaccuracies in the measured misalignment Δx and Δy between the corresponding pairs of diamonds. These errors in measured Δx and Δy, in-turn, lead to errors in compensation operations intended to correct printing errors resulting from such die misalignment.

Figure 5:
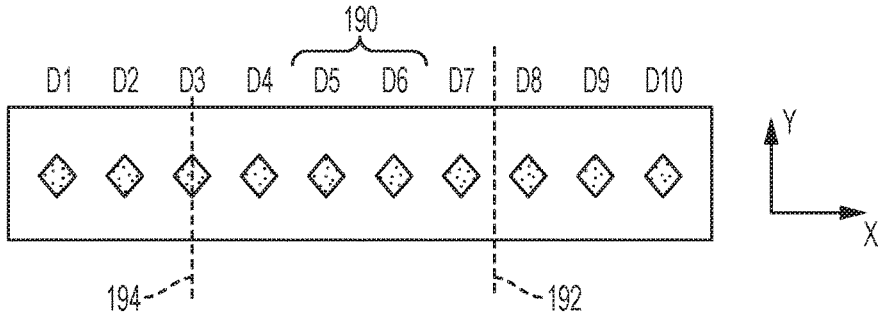
FIG. 5 is a block diagram illustrating a portion of a calibration pattern, according to one example.

FIG. 5 is diagram illustrating an example of diamonds D1 through D10 of a row of diamonds of a ROI 174 of calibration pattern 170, such as ROI 174-1, for example. According to one example, when scanning calibration pattern 170 with scanbar 160, a chip gap location between consecutive sensor chips 162 of scanbar 160 may pass between an adjacent pair of diamonds, such as between diamonds D7 and D8, as illustrated by dashed line 192. According to such an instance, the chip gap at 192 will cause the measured misalignment Δx and Δy between diamonds D7 and D8 to be inaccurate. As such, as will be described in greater detail below, according to one example, diamond pairs between which a chip gap passes are deemed by alignment controller 142 to be invalid for determining misalignment between adjacent printhead dies 114 corresponding to the ROI.

According to one example, when scanning calibration pattern 170 with scanbar 160, a chip gap location between consecutive sensor chips 162 of scanbar 160 may pass directly through a portion of a diamond, such as through diamond D3, as illustrated by dashed line 194. According to such an instance, the chip gap at 194 will cause errors in determination of the centroid of diamond D3 which, in-turn, will cause errors in measured misalignment Δx and Δy between both the pair of diamonds D3 and D2, and the pair of diamonds D3 and D4. As such, as will be described in greater detail below, according to one example, diamond pairs including a diamond through which a chip gap passes are deemed by alignment controller 142 to be invalid for determining misalignment between adjacent printhead dies 114 corresponding to the ROI.

Figure 6:
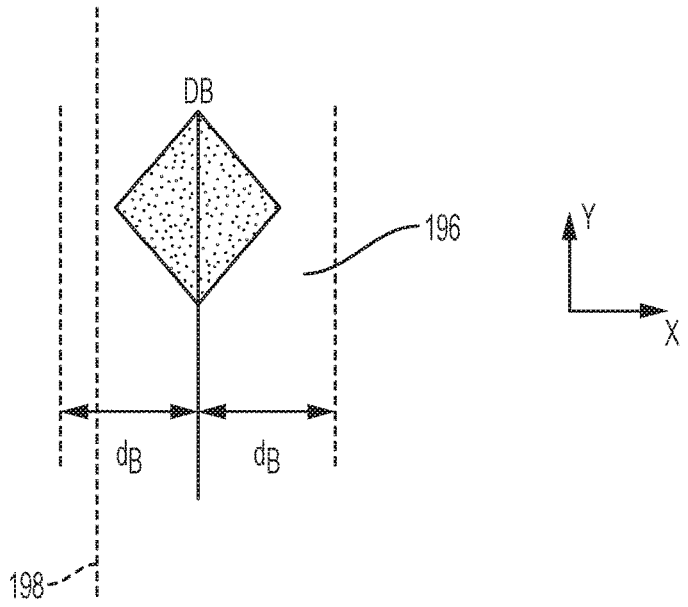
FIG. 6 is a block diagram illustrating a portion of a calibration pattern, according to one example.

With reference to FIG. 6, according to one example, a diamond is deemed to be invalid if a chip gap passes with a defined diamond boundary extending beyond an extent of a printed diamond. As an illustrative example, a diamond from a row of column set of calibration pattern 170, such as diamond D3 of column set 174-1, has a predefined diamond boundary extending a distance $d_B$ in each direction along the x-axis from a centroid of diamond D3. When scanning calibration pattern 170 with scanbar 160, even though not passing directly through any portion of diamond D3, if a chip gap passes within diamond boundary 196, such as indicated by the dashed line at 198, diamond D3 is deemed invalid. According to such example, similar to that described with respect to chip gap 194 passing directly through a portion of a diamond, diamond pairs including a diamond having a diamond boundary through which a chip gap passes are deemed by alignment controller 142 to be invalid for determining misalignment between adjacent printhead dies 114 corresponding to the ROI.

Figure 7:
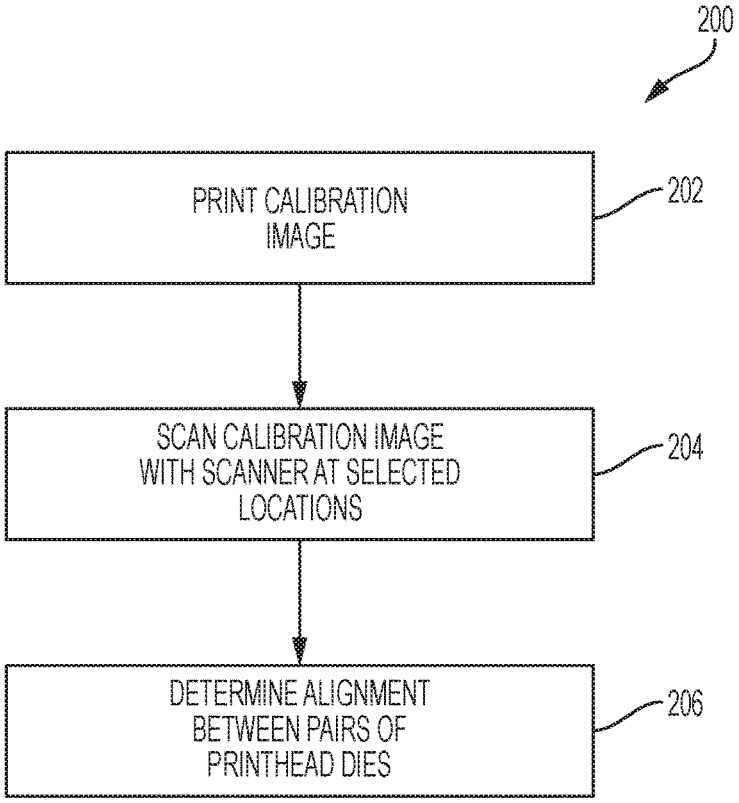
FIG. 7 is a flow diagram illustrating a method for measuring die alignment, according to one example.

FIG. 7 is a flow diagram 200 generally illustrating one example of a method, according to the present disclosure, for measuring die-to-die alignment between printhead dies 114 of printbar 102 using scanbar 160 which eliminates errors in measured misalignment Δx and Δy between diamond pairs that might otherwise result from gaps between sensor chips 162 of scanbar 160. At 202, alignment controller 142 instructs printbar 102 to print a calibration pattern on a calibration, such as calibration pattern 170 on calibration page 172.

At 204, alignment controller 142 positions scanbar 160 at a plurality of selected positions along carriage rod 166, where the positions are selected so that each alignment region 190 of each row of each ROI 174 of calibration pattern 170, each corresponding to a different die-to-die boundary location between printhead dies 114 of printbar 102, is scanned at least once by linear array 165 of scanbar 160 at a location that does not correspond to a chip gap location between successive sensor chips 162 (e.g. chip gaps $g_1$ to $g_{n-1}$ of FIG. 3).

At each selected position, scanbar 160 scans calibration pattern 170 as calibration page 172 is moved along transport path 150 in print direction 152 to provide a corresponding calibration image. After each scan, alignment controller 142 reverses the transport direction of calibration page 172 along transport path 150 until calibration page 172 is upstream of scanbar 160. Scanbar 160 is moved to the next selected position and calibration page 172 is again transported in print direction 152 and scanned by scanbar 160 to provide a corresponding calibration image. After being scanned with scanbar 160 at a final selected location, calibration page 172 is moved along transport path 150 and ejected from printing system 100.

At 206, alignment controller 142 determines the die alignment for each successive pair of printhead dies 114 of printbar 102 based on the plurality of calibration images. In one example, as described above, alignment controller determines the die alignment for each successive pair of printhead dies 114 by measuring Δx and the Δy between centroids of each valid pair of corresponding diamonds D5 and D6 (i.e. those pairs of diamonds D5 and D6 not deemed invalid by positions of sensor chip gaps) of each row of corresponding ROI 174 of each calibration image. As described above, alignment controller 142 determines an average of all Δx and the Δy measurements associated with each pair of diamonds D5 and D6 corresponding to each pair of printhead dies 114, where the average values represent the misalignment between the corresponding pair of printhead dies 114.

Based on the selected positons at which scanbar 160 scans calibration pattern 170 (i.e. each alignment region 190 is scanned at least once at a non-chip gap location of scanbar 160), the alignment region 190 (i.e. the pair of diamonds D5 and D6) in each row of each ROI 174 can be used from at least one calibration image to determine die alignment (i.e. Δx and Δy) between the corresponding pair of printhead dies 114. As such, a die alignment measurement process using scanbar 160, in accordance with the present disclosure, eliminates errors that might otherwise be introduced by chip gaps between sensor chips of scanbar 160, and provides printhead die alignment measurement that is faster and more accurate than that provided by scanning densitometers, and at a cost savings relative to full-width scanbars. Additionally, by eliminating measurement errors that would otherwise occur due to sensor chip gaps, measurements made by indexing scanbar 160, in accordance with the present disclosure, are more accurate than similar measurements made using full-width scanbars.

An example of a die alignment process, in accordance with the present disclosure, is described below. As described above, alignment controller 142 instructs printbar 102 to print calibration pattern 170 on calibration page 172. In one example, to determine the selected positions at which scanbar 160 will be positioned to scan calibration pattern 170, a correlation process is performed to correlate the pixel locations of scanbar 160 to the printing pixel locations (nozzles 116 of printhead dies 114) of printbar 102.

As part of a correlation process, alignment controller 142 moves scanbar 160 to a known reference location along carriage rod 166, such as the "home" position illustrated in FIG. 2. A correlation scan of calibration page 172 is then made which includes one of the side edges of calibration page 172 and at least one fiducial marker, such as the top and bottom fiducial diamonds corresponding to the edge of the calibration page being scanned, for example. With reference to FIG. 2, according to one example, with scanbar 160 in the "home" position on the left-hand side of transport path 150, a correlation scan by scanbar 160 includes the left-hand edge of calibration page 150 and fiducial diamond 176 in the top, left-hand corner of calibration pattern 170.

Alignment controller 142 uses the pixel data from the calibration image to determine the selected positions along carriage bar 166 at which to position scanbar 160 to scan calibration pattern 170 to provide calibration images. In one example, from the reflectance values of the pixels of the calibration image, alignment controller determines a position of the edge of the calibration page 172 (in this case the left-hand edge) and the position of the fiducial diamond 176. Based on the known locations of the sensor chips gaps ($g_1$ to $g_{n-1}$, FIG. 3) relative to the known position of scanbar 160, on the known locations of each calibration region 190 of each ROI 174 relative to fiducial diamond 176, and on the measured locations of fiducial diamond 176 and the left-hand edge of calibration page 172, alignment controller 142 determines the relative locations of chip gaps $g_1$ to $g_{n-1}$ to each column of diamonds of each ROI 174, including the diamonds D5 and D6 of each calibration region 190 of each ROI 174.

Based on the known relative positions of chip gaps $g_1$ to $g_{n-1}$ of sensor chips 162 of scanbar 160 to the columns of diamonds of each ROI 174, alignment controller 142 determines a set of selected positions at which to locate scanbar 160 along carriage rod 166 so that each calibration region 190 of each ROI 174 is scanned at least once at a non-gap location of scanbar 160. In one example, alignment controller 142 determines a first selected position for scanbar 160 along carriage rod 166 such that the alignment region 190 of the first ROI 174-1 is scanned at a non-gap location of scanbar 160. According to such example, alignment controller next determines a last selected position for scanbar 160 along carriage rod 166 such that the alignment region 190 of the last ROI 174-9 is scanned at a non-gap location of scanbar 160.

Alignment controller 142 then determines additional selected positions between the first and last selected positions so that any alignment regions 190 of the remaining ROI's 174-2 through 174-8 that were not already aligned with a non-gap location with scanbar 160 positioned at the first and last selected positions, will be scanned at a non-gap location of scanbar 160. In one example, alignment controller 142 determines selected positions so that a minimal number of scans are required to scan each alignment region 190 of each ROI 174 at least once at a non-gap location of scanbar 160. In one example, only one additional selected position between the first and last selected positions may be required to scan each alignment region 190 of each ROI 174 at least once. In other examples, two or more additional selected positions between the first and last selected positions may be required to scan each alignment region 190 of each ROI 174 at least once.

After the selected positions are determined, alignment controller 142 successively indexes scanbar 160 to each of the selected positions and scans calibration pattern 170 to obtain corresponding calibration images. A scanning operation for obtaining each calibration image at each selected position, according to one example, is described below.

At each selected position, scanbar 160 is positioned so as to scan at least one pair of fiducial diamonds, such as fiducial diamond 176 in the upper left-hand corner and a fiducial diamond in the lower left corner (not illustrated), or fiducial diamond 178 in the upper right-hand corner and a fiducial diamond in the lower right corner (not illustrated), for example. Because a position of calibration pattern may change as it is transported back and forth along transport path 150, for each calibration image, alignment controller 142 determines centroids of each fiducial diamond of the pair and determines a skew of the image (e.g. from x- and y-axes, see FIG. 2, also referred to as horizontal and vertical directions). Based on the determined skew, alignment controller 142 deskews the calibration image to provide a deskewed calibration image.

In one example, using the deskewed calibration image, alignment controller 142 measures misalignment $\Delta x$ and $\Delta y$ between alignment diamonds D5 and D6 of each alignment region 190 of each row of each ROI 174 included in the deskewed calibration image. Based on the known positions of chips gaps $g_1$ to $g_{n-1}$ of scanbar 160 at the given selected location, alignment controller 142 discards $\Delta x$ and $\Delta y$ measurements of all diamond pairs deemed to be invalid due to alignment with one of the chip gap $g_1$ to $g_{n-1}$, as described above by FIGS. 5 and 6.

In one example, alignment module 142 not only measures misalignment $\Delta x$ and $\Delta y$ between alignment diamonds D5 and D6 of each alignment region 190 of each ROI 174, but also measures misalignment $\Delta x$ and $\Delta y$ between each valid adjacent pair of in-die diamonds of each ROI 174 of the deskewed calibration. In the illustrated example, for a given ROI 174 diamonds D1-D5 are in-die diamonds printed by one printhead die, and diamonds D6-D10 are in-die diamonds printed by the adjacent printhead corresponding to the given ROI 174 In the illustrated example, there are 8 in-die pairs of diamonds for a given ROI 174 (i.e., D1-D2, D2-D3, D3-D4, D4-D5, D6-D7, D7-D8, D8-D9, and D9-D10). The misalignment values $\Delta x$ and $\Delta y$ between all valid pairs of in-die diamonds are averaged. Because such in-die diamonds are printed with a high degree of accuracy, deviation from expected spacing between such in-die diamonds is attributed to a magnification error of the deskewed calibration image by scanbar 160 and to media transport accuracy.

According to one example, alignment controller 142, based on the averaged $\Delta x$ and $\Delta y$ between in-die diamond pairs, determines a magnification correction factor, and applies the magnification factor to the measured misalignment $\Delta x$ and $\Delta y$ between alignment diamonds D5 and D6 of each alignment region 190 from the deskewed calibration image. Such magnification correction increases the accuracy of the measured misalignment $\Delta x$ and $\Delta y$ between alignment diamonds D5 and D6 of each alignment regions 190.

The above process is repeated for each calibration image provided by scanbar 160 at each of the selected positions along carriage rod 166. After the final calibration image formed (with scanbar 160 at the last selected position) and analyzed by alignment module 142, for each alignment region 190 all of each ROI 174, the measured misalignment values $\Delta x$ and $\Delta y$ are averaged, wherein the averaged values of $\Delta x$ and $\Delta y$ for each ROI 174 represents the measured die misalignment between the corresponding pairs of printhead dies 114. According to one example, electronic controller 110 uses the measured die misalignment for each pair of successive printhead dies 114 of printbar 102 to perform a compensation operation during printing (e.g. adjust the timing of the firing of nozzles 116 between adjacent dies 114, and to adjust the first printing nozzle 116 of adjacent printhead dies 114 in nozzle overlap regions between adjacent printhead dies, so that ejected ink drops properly align in a printed image).

In one example, in addition to invalidating diamonds of calibration pattern 170 based on positions of sensor chip gaps $g_1$ to $g_{n-1}$, alignment controller 142 analyzes and compares the shapes/dimensions of all diamonds of each calibration image to expected dimensions. If the dimensions of a diamond deviate too far from expected dimensions, the diamond is deemed invalid and not used for measuring the $\Delta x$ and $\Delta y$ of associated diamond pairs, as such measurement will not be accurate due to the misshapen diamond. In addition to a chip gap passing through a diamond, a diamond may be misshapen for any number of other reasons such as a malfunctioning print nozzle 116, a malfunctioning scanner pixel, or an optical phenomenon such as "star burst", for example. By eliminating such misshapen diamonds, the accuracy of die-to-die alignment measurements is further increased, thereby leading to improved compensation processes.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A method comprising:

printing a calibration pattern with a wide array printhead having a plurality of printhead dies, the calibration pattern having alignment regions;

scanning the calibration pattern with a scanbar having a width less than a width of the wide array printhead by indexing the scanbar to a plurality of selected positions across a width of the calibration pattern and providing a scanned calibration image at each selected position, the calibration images together providing a scan of the full width of the calibration pattern, wherein the scanbar has a plurality of sensor chips with gaps between successive sensor chips and the selected positions are selected so that the scanbar scans each alignment region at least once at a non-chip gap location of the scanbar; and measuring alignment between successive printhead dies based on the calibration images.

2. The method of claim 1, wherein the alignment regions correspond to boundaries between successive printhead dies.

3. The method of claim 2, determining the selected locations being based on known locations of sensor chip gaps relative to a known location of the scanbar relative to the width of the calibration page, and on known positions of printhead die boundaries relative to a fiducial marker included in the calibration pattern printed by the wide array printhead.

4. The method of claim 2, the calibration pattern including regions of interest corresponding to each successive pair of printhead dies, each region of interest comprising shapes printed by the corresponding pairs of printhead dies, and each region of interest including alignment regions, each alignment region including a pair of adjacent printed shapes with one of the pair of adjacent printed shapes printed by each of the corresponding pairs of printhead dies, and measuring alignment between the corresponding pairs of printhead dies includes measuring a difference in spacing between the pairs of adjacent printed shapes of the alignment regions and an expected spacing there between.

5. The method of claim 4, wherein measuring alignment between corresponding pairs of printhead dies includes averaging the measured difference in spacing between the pairs of adjacent printed shapes of each of the alignment regions of each of the regions of interest corresponding to the pairs of printhead dies.

6. The method of claim 4, including excluding from measurement those alignment regions where a chip gap passes between the pair of adjacent printed shapes or passes through one of the pair of adjacent printed shapes.

7. The method of claim 6, including excluding from measurement those alignment regions where a chip gap passes within a certain predefined distance from either one of the pair of adjacent printed shapes.

8. The method of claim 4, each region of interest including in-die pairs of printed shapes, with each printed shape of each in-die pair printed by a same printhead die of the pair of printhead dies corresponding to the region of interest, the method including measuring a difference in spacing between in-die pairs of shapes and an expected spacing, and scaling the corresponding scanned calibration images based on the measured differences.

9. A printer comprising:

a wide array printhead having a plurality of printhead dies arranged transversely across a printing path, the printhead to print a calibration pattern having alignment regions;

a scanner having a width less than the printhead, a plurality of sensor chips with gaps between successive sensor chips, and being moveable across the printing path, the scanner to provide calibration images by scanning the calibration pattern at a plurality of selected positions across the printing path, the calibration images together providing a scan of a full width of the calibration pattern, the selected positions are selected so that each alignment region is scanned at least once at a non-chip gap location of the scanner; and an alignment controller to measure alignment between dies based on the calibration images.

10. The printer of claim 9, the selected locations being based on known locations of sensor chip gaps relative to a known location of the scanbar relative to the width of the calibration page, and on known positions of printhead die boundaries relative to a fiducial marker included in the calibration pattern printed by the wide array printhead.

11. The printer of claim 9, the alignment regions corresponding to boundaries between successive printhead dies of the wide array printhead.

12. The printer of claim 11, the calibration pattern including regions of interest corresponding to each successive pair of printhead dies, each region of interest comprising shapes printed by the corresponding pairs of printhead dies, and each region of interest including alignment regions, each alignment region including a pair of adjacent printed shapes with one of the pair of adjacent printed shapes printed by each of the corresponding pairs of printhead dies, the alignment controller to measure alignment between the corresponding pairs of printhead dies by measuring a difference in spacing between the pairs of adjacent printed shapes of the alignment regions and a predetermined expected spacing there between.

13. The printer of claim 12, the alignment controller to measure alignment between corresponding pairs of printhead dies by averaging measured differences in spacing between the pairs of adjacent printed shapes of each of the alignment regions of each of the regions of interest corresponding to the pairs of printhead dies.

14. The printer of claim 11, the alignment controller to exclude from measurement those alignment regions where a chip gap passes between the pair of adjacent printed shapes, passes through one of the pair of adjacent printed shapes, or passes within a certain predefined distance from either one of the pair of adjacent printed shapes.

15. A die alignment system comprising:

a scanner moveable across a printing path, the scanner having a width less than a width of the calibration pattern and a plurality of sensor chips with gaps between successive sensor chips, the scanner to scan a calibration pattern when positioned at plurality of selected positions across the printing path to provide a calibration image at each selected position, the calibration images together providing a scan of the full width of the calibration pattern, wherein the calibration pattern is printed by a wide array printhead comprising printhead dies and the selected positions are selected so that the scanner scans each alignment region at least once at a non-chip gap location of the scanner; and an alignment controller to measure alignment between the printhead dies based on the calibration images.

* * * * *